US008369737B2

(12) United States Patent
Sakamoto et al.

(10) Patent No.: US 8,369,737 B2
(45) Date of Patent: Feb. 5, 2013

(54) DEVELOPING DEVICE AND IMAGE FORMING APPARATUS USING THE SAME

(75) Inventors: Takashi Sakamoto, Kanagawa (JP); Keisuke Kubo, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 381 days.

(21) Appl. No.: 12/547,908

(22) Filed: Aug. 26, 2009

(65) Prior Publication Data

US 2010/0150603 A1 Jun. 17, 2010

(30) Foreign Application Priority Data

Dec. 17, 2008 (JP) ..... P2008-320520

(51) Int. Cl.
*G03G 15/08* (2006.01)

(52) U.S. Cl. ..... 399/105; 399/103

(58) Field of Classification Search ..... 399/105, 399/103

See application file for complete search history.

(56) References Cited

U.S. PATENT DOCUMENTS

| | | | | |
|---|---|---|---|---|
| 6,195,515 | B1 | 2/2001 | Fujita et al. | 399/103 |
| 6,826,378 | B2 * | 11/2004 | Ochiai | 399/103 |
| 2008/0080906 | A1 | 4/2008 | Kawahara et al. | |

FOREIGN PATENT DOCUMENTS

| | | | |
|---|---|---|---|
| JP | 6-130804 | A | 5/1994 |
| JP | 11-316500 | A | 11/1999 |
| JP | 2000-75656 | A | 3/2000 |
| JP | 2007-271735 | A | 10/2007 |
| JP | 2008-89730 | A | 4/2008 |

* cited by examiner

*Primary Examiner* — Constantine Hannaher
(74) *Attorney, Agent, or Firm* — Sughrue Mion, PLLC

(57) ABSTRACT

A developing device includes: a casing that has a housing part, an upstream edge and a downstream edge, and a rectangular opening that opposes a development region, the rectangular opening being provided between the upstream and downstream edges; a cylindrical developer conveying body to rotate in a state of passing the rectangular opening, the cylindrical developer conveying body conveying the developer to the development region; and a flexible sheet member that has an upstream end part and a downstream end part, the upstream end part being fixed at the downstream edge of the casing, the downstream end part being a free end and coming into contact with a layer of the developer in a rotation axis direction of the developer conveying body at a position of the developer conveying body which passes the downstream edge of the opening.

8 Claims, 11 Drawing Sheets

DEVELOPING DEVICE AND IMAGE FORMING APPARATUS USING THE SAME

CROSS-REFERENCE TO RELATED APPLICATION

This application is based on and claims priority under 35 USC 119 from Japanese Patent Application No. 2008-320520 filed Dec. 17, 2008.

BACKGROUND

1. Technical Field

This invention relates to a developing device and an image forming apparatus using the same.

2. Related Art

In an image forming apparatus utilizing an electrophotographic system, an electrostatic recording system or the like, such as printer, copying machine and facsimile, a developing device for developing an electrostatic latent image formed on an image holding member such as photoreceptor with a powdery developer is used.

SUMMARY

According to an aspect of the invention, there is provided a developing device, including:

a casing that has:

a housing part that houses a developer;

an upstream edge and a downstream edge positioned in an upstream side and a downstream side of a rotation direction of a developer conveying body, respectively; and a rectangular opening that opposes a development region for performing development with the developer, the rectangular opening being provided between the upstream edge and the downstream edge;

a cylindrical developer conveying body that is provided inside of the casing to rotate in a state of passing the rectangular opening, the cylindrical developer conveying body conveying the developer to the development region by holding the developer on an outer circumferential surface; and a flexible sheet member that has an upstream end part and a downstream end part positioned in an upstream side and a downstream side of the rotation direction of the developer conveying body, respectively, the upstream end part of the flexible sheet member being fixed at the downstream edge of the casing, the downstream end part of the flexible sheet member being a free end and coming into contact with a layer of the developer in a rotation axis direction of the developer conveying body at a position of the developer conveying body which passes the downstream edge of the opening, the layer of the developer being held on the outer circumferential surface portion of the developer conveying body working out to a developer holding region.

BRIEF DESCRIPTION OF THE DRAWINGS

Exemplary embodiments of the present invention will be described in detail based on the following figures, wherein.

DETAILED DESCRIPTION

Figure 1:
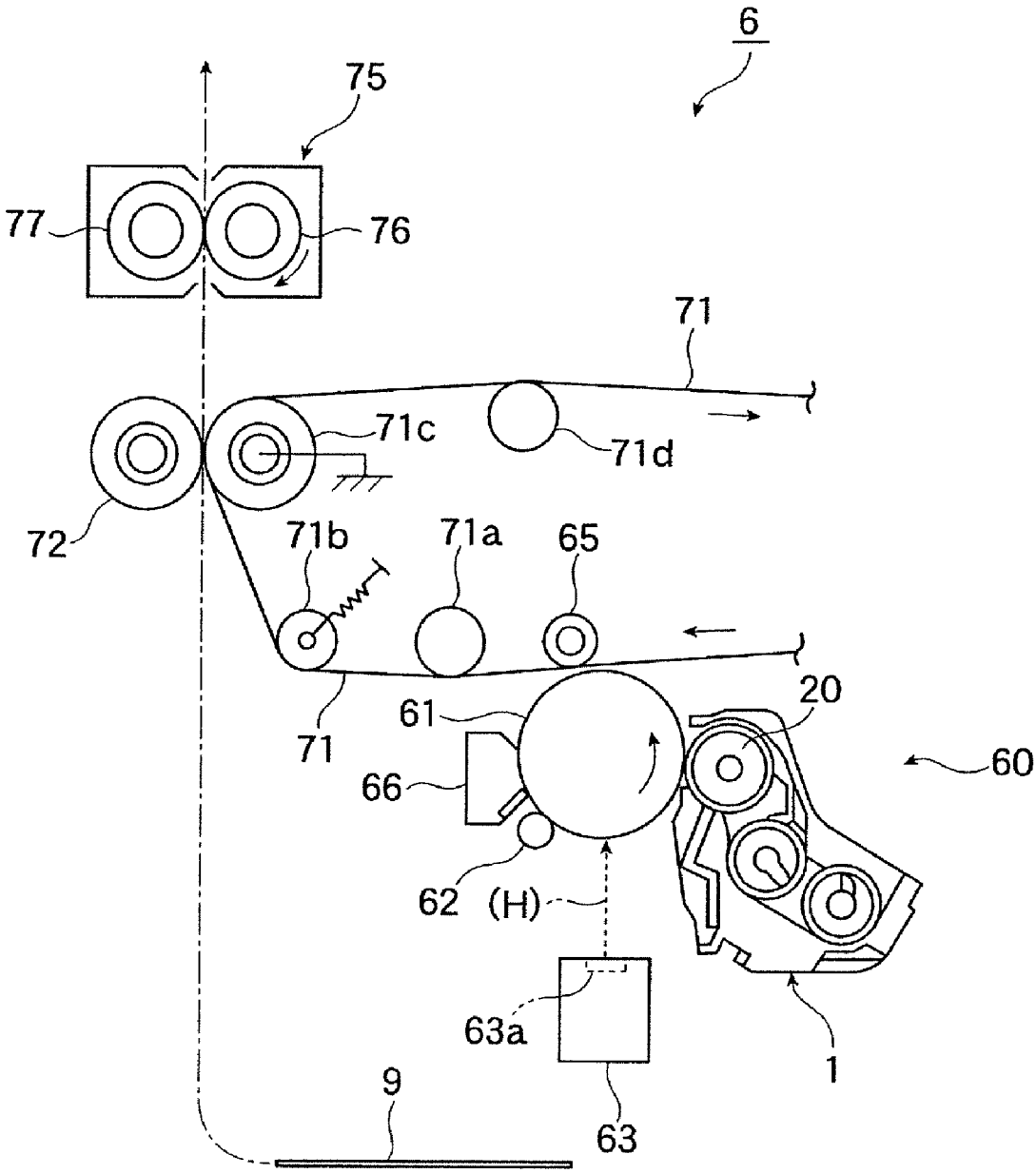
FIG. 1 represents an explanatory view showing main parts of the image forming apparatus using the developing device according to the exemplary embodiment.

The best mode for carrying out this invention (hereinafter, simply referred to as the "exemplary embodiment") is described below by referring to the drawings attached.

Figure 2:
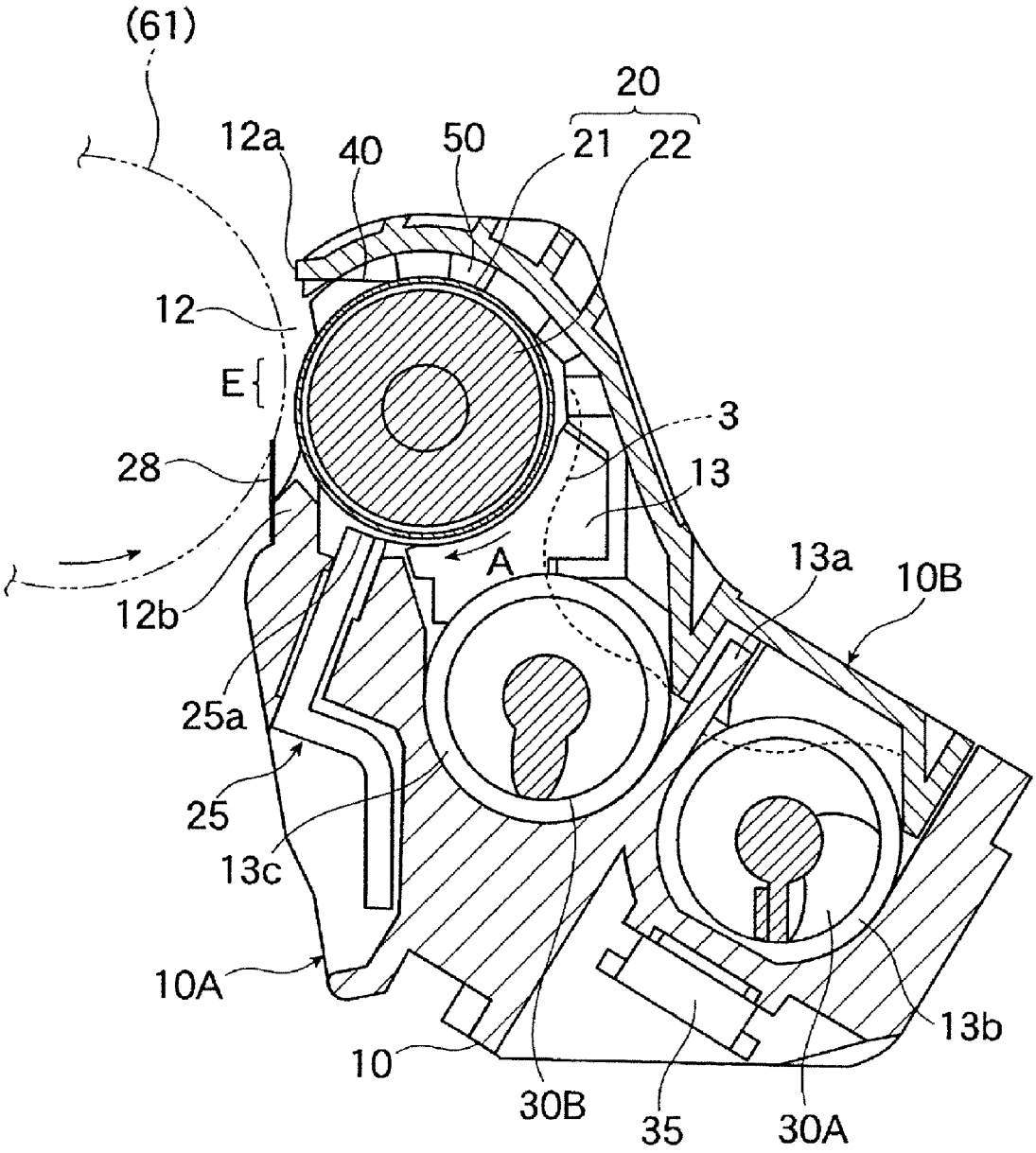
FIG. 2 represents a cross-sectional view showing the developing device used in the image forming apparatus of FIG. 1.

FIG. 1 shows main parts of an image forming apparatus 6 to which the developing device 1 of the present invention is applied, and FIG. 2 shows the developing device 1.

In the image forming apparatus 6, an image making apparatus 60 for forming a toner image composed of a toner as the developer by utilizing a known electrophotographic process or the like is provided in the internal space of a casing constructed from a supporting member, an exterior cover and the like (not shown).

This image making apparatus 60 employs an intermediate transfer system using an intermediate transfer member 71 such as belt-like member and in practice, has a construction such that a plurality of image making apparatuses 60 for forming toner images differing in the color from each other are disposed in an array along the direction of rotational movement of the intermediate transfer member 71 (in FIG. 1, other image making apparatuses are disposed on the right side).

In the image making apparatus 60, the circumferential surface serving as an image forming region of a drum-like photoreceptor 61 rotationally driven in the direction shown by an arrow (in this exemplary embodiment, in the counterclockwise direction) is electrically charged to a predetermined potential by a charging device 62, and light (H) based on image information (signal) is irradiated on the circumferential surface of the electrically charged photoreceptor 61 from an exposure device 63 to form an electrostatic latent image with a potential difference.

Subsequently, in the image making apparatus 60, the electrostatic latent image formed on the photoreceptor 61 is developed with a toner of predetermined color supplied from the developing device 1 to visualize the image as a toner image, and the toner image is transferred by a primary transfer device 65 onto the belt-like intermediate transfer member 71 rotationally moving in a state of being in contact with the photoreceptor 61. The toner and the like remaining on the circumferential surface of the photoreceptor 61 after transfer are removed by a cleaning device 66.

In the image making apparatus 60, a toner image is formed through such an image making process. In the case where a plurality of image making apparatuses 60 are disposed, toner images of respective colors are formed also in other image making apparatuses through the image making process similar to the above, and the toner images are transferred onto the intermediate transfer member 71 and superposed in registration with each other. Also, in the image making process above, a charging voltage, a development voltage and a primary transfer voltage are applied from power sources (not shown) to the charging device 62, the developing device 1 and the primary transfer device 65, respectively.

The toner image transferred to the intermediate transfer member 71 is transferred onto paper 9 that is conveyed from a feeding device (not shown) by a secondary transfer device 72 and delivered between the intermediate transfer member 71 and the secondary transfer device 72. The belt-like intermediate transfer member 71 is disposed in a state of lying on the upper side of the image making apparatus 60 and specifically, hung over a plurality of belt-supporting rolls 71*a* to 71*d* or the like to rotate in the direction shown by an arrow. The supporting roll 71*b* is a tension (tensioning) roll, and the supporting roll 71*c* is a backup roll in abutted contact with the secondary transfer device. To the secondary transfer device 72, a secondary transfer voltage is applied from a power source (not shown) in the secondary transfer step.

In the image forming apparatus 6, a fixing device 75 is disposed in a state of lying on the upper side of the secondary transfer device 72 in the internal space of the casing (not shown). The fixing device 75 is constructed by providing, in a casing, a heating rotator 76 in the form of a roll, a belt or the like, which is rotationally driven in the direction shown by an arrow and is heated and kept at a predetermined surface temperature by a heating unit, and a pressurizing rotator 77 in the form of a roll, a belt or the like, which is contacted with the heating rotator 76 under a predetermined pressure nearly along the axis direction and is rotated by following.

The paper 9 onto which the toner image is transferred by the image making apparatus 60 employing the intermediate transfer system is introduced into the fixing device 75. In the fixing device 75, the paper 9 having transferred thereonto a toner image is heated and pressurized when passing through the contact part between the heating rotator 76 and the pressurizing rotator 77, whereby the toner image is melted and fixed on the paper 9. The paper 9 after the completion of fixing is discharged from the fixing device 75 and then conveyed to a discharged paper housing part or the like (not shown).

Here, in the exposure device 63, exposure is performed based on image processing signals obtained after image information input from an information source connected to or mounted in the image forming apparatus 6, such as original reading device, externally connected equipment or recording medium reading device, is subjected to a predetermined processing by an image processing apparatus (not shown). The exposure device 63 used is, for example, an LED array where a plurality of light-emitting diodes (LED) or various optical components are combined. In this exemplary embodiment, an exposure device 63 having a construction such that a light output part 63*a* outputting light (H) for exposure is integrally provided on the top of the exposure device body and at the same time, the entire device including the light output part 63*a* is disposed at a position on the lower side of the photoreceptor 61, is applied.

The developing device 1 in the image making apparatus 60 is described in detail below.

The developing device 1 has, as shown in FIGS. 2 to 5 and the like, a housing 10 as the casing, a developing roll 20 as the developer conveying body, a layer thickness-regulating plate 25 as the layer-regulating member, and two screw augers 30A and 30B as the developer stirring conveying member. In FIG. 2, numeral 3 indicates a two-component developer (its depositional surface and the like) containing a nonmagnetic toner and a magnetic carrier, and the symbol E indicates a development region on the circumferential surface of the photoreceptor 61 when performing the development by the developing device 1.

The housing 10 is constructed such that a nearly rectangular opening 12 is formed at a site on the side opposing the development region E along the rotation axis direction of the photoreceptor 61 and a developer housing part 13 serving as an internal space for housing a two-component developer 3 is formed at a site lying on the side opposite the opening 12. The housing part 13 takes a configuration having two parallel rows of developer circulating conveying paths 13*b* and 13*c* connected to each other at both end parts and partitioned at the center part by a partition wall 13*a*. In both end parts of the partition wall 13*a*, accessways 14*a* and 14*b* each connecting two rows of developer circulating conveying paths 13*b* and 13*c* are present.

Figure 3:
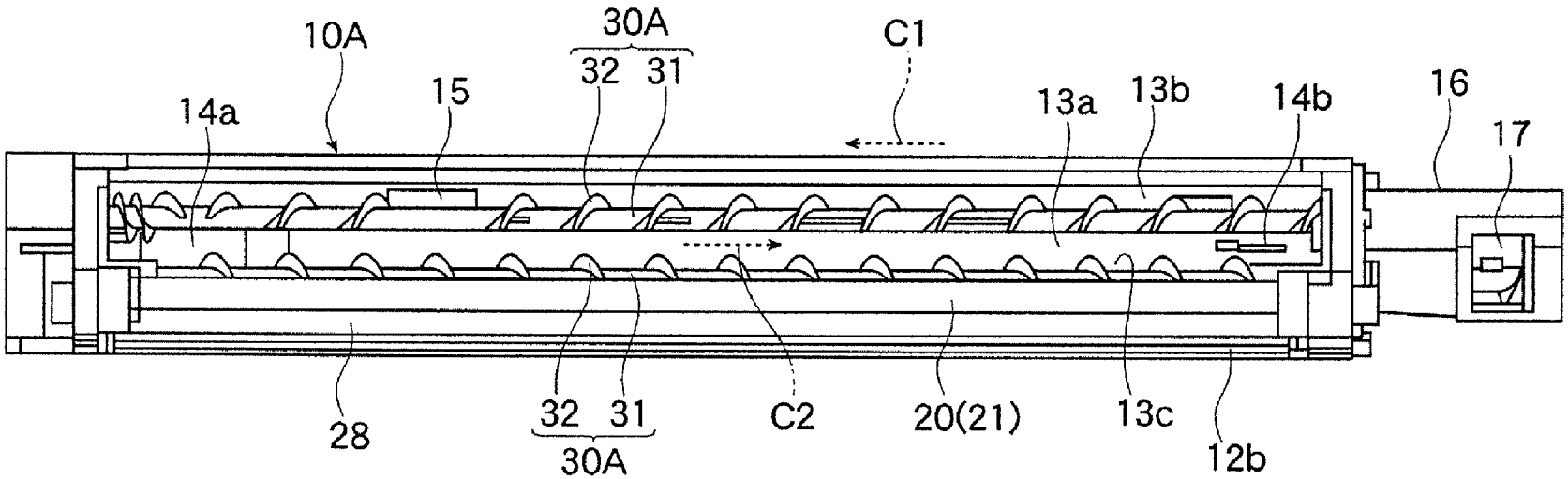
FIG. 3 represents a top view when the state of a housing cover part of the developing device of FIG. 2 being removed is viewed from above.
Figure 4:
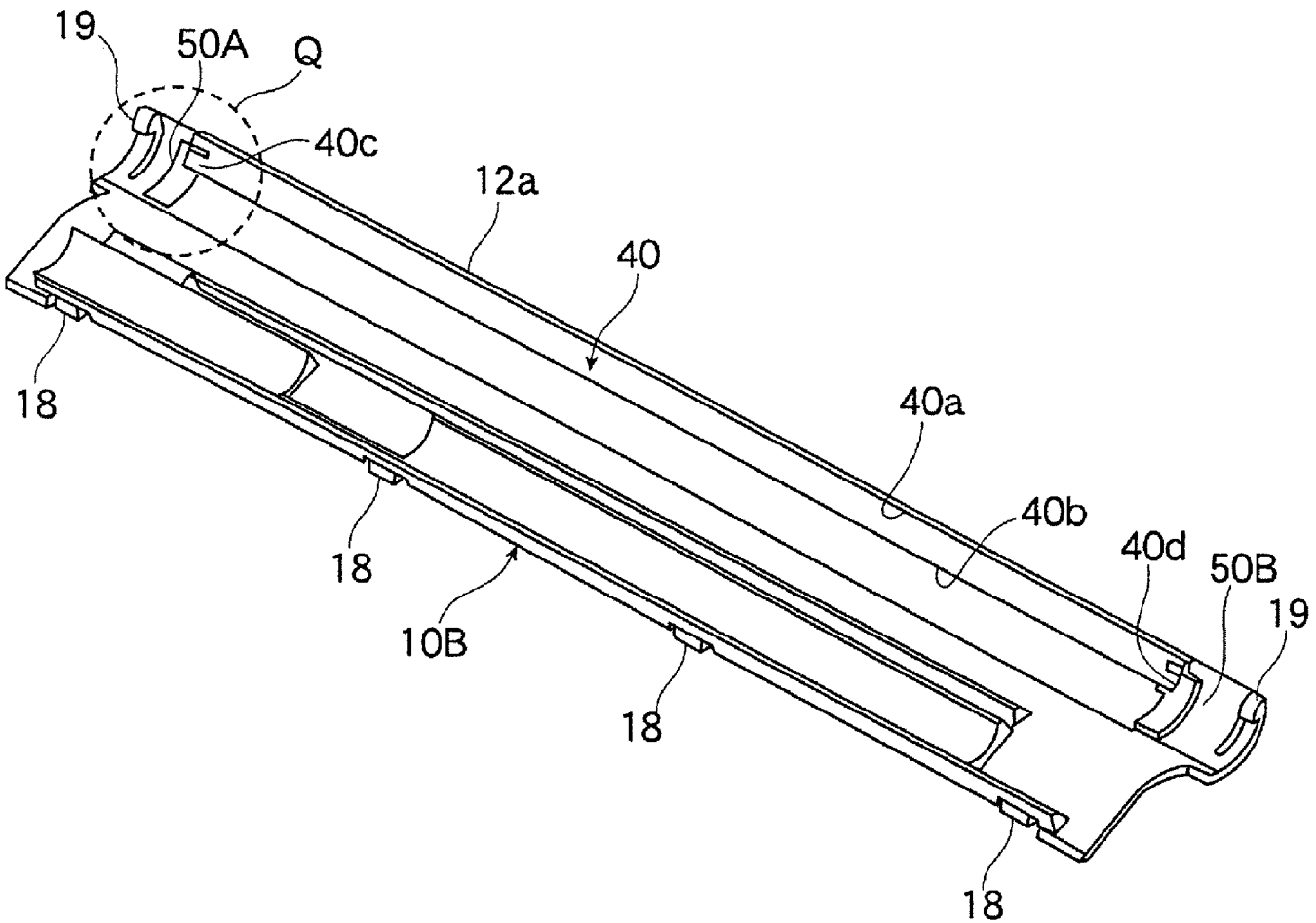
FIG. 4 represents a perspective view showing the state of the housing cover part of the developing device of FIG. 2 being turned up.

Also, the housing 10 has a construction that is divided into a main body part 10A on the bottom side, in which the opening 12 and main structure portions of the housing part 13 are formed, and a cover part (upper cover) 10B attached in a state of covering the top surface part (top plate) of the main body 10A, thereby forming the opening 12 and the remaining part (top part) of the housing 13. FIG. 3 shows the housing main body 10A in a state of the cover part 10B of the housing 10 being removed, and FIG. 4 shows the housing cover part 10B in a state of being removed from the main body 10A and turned up.

The developing roll 20 is composed of a cylindrical sleeve 21 provided inside of the housing 10 to rotate in a state of passing the opening 12, and a magnet roll 22 fixed in the internal space of the sleeve 21. The developing device 1 is provided in a state such that the developing roll 20 (its sleeve 21) is kept apart at a predetermined distance from and not put into contact with the outer circumferential surface portion serving as the development region E of the photoreceptor 61.

The sleeve 21 of the developing roll 20 is supplied with power from a rotation driving device (not shown) and rotationally driven in the direction (in this exemplary embodiment, in the clockwise direction) A shown by an arrow, and at the same time, a development voltage for forming a development electric field between the sleeve and the photoreceptor 61 is applied from a power source (not shown). As regards the development voltage, for example, a dc voltage overlapped with an ac component is applied. Also, the sleeve 21 is made of a non-magnetic material (for example, stainless, aluminum, etc.) and formed in the shape of a cylinder having nearly the same width (length) as the image forming region in the rotation axis direction of the photoreceptor 61. Furthermore, the sleeve 21 is disposed to oppose the photoreceptor 61 in a state of its rotation axis direction B (see, FIGS. 5 and 8) being nearly in parallel to the rotation axis direction of the photoreceptor. The magnet roll 22 has a structure where a plurality of magnetic poles for generating magnetic field lines or the like to attach the magnetic carrier of the developer to the outer circumferential surface of the sleeve 21 by a predetermined magnetic force are disposed at predetermined angles.

The layer thickness-regulating plate 25 is shaped as a plate having nearly the same length as the developer holding region 21*a* in the rotation axis direction B of the sleeve 21 and formed using a nonmagnetic material (for example, stainless steel). The layer thickness-regulating plate 25 is installed in the main body 10A of the housing 10 to produce a state of its distal end 25*a* coming to oppose the outer circumferential surface of the developing roll 20 (its sleeve 21) with a gap for regulating the layer thickness of the two-component developer 3 held on the outer circumferential surface to a predetermined thickness.

The screw augers 30A and 30B both are formed in a state such that a protruding blade part 32 for conveying the two-component developer 3 with stirring is spirally wound around the rotation axis 31 at a predetermined pitch. The augers 30A and 30B are installed to be rotationally driven in a direction enabling the developer 3 present in two rows of developer circulating conveying paths 13*b* and 13*c* in the developer housing part 13 of the housing 10 to be conveyed in fixed directions (in FIG. 3, arrows C1 and C2) into both conveying paths.

Here, in FIG. 2, numeral 35 is a magnetic sensor for detecting the toner concentration of the developer 3 in the conveying path 13*b*. The magnetic sensor 35 is installed such that the detection surface is present in a detection and installation opening 15 (FIG. 3) formed at the bottom part of the conveying path 13*b*. Also, in FIG. 2, numeral 28 is a sealing member for stopping the gap between a part (upstream edge 12*b*) of the developing device 1 and the photoreceptor 61. The sealing member (gap stopping member) 28 is disposed in a state such that its bottom end is fixed, out of opening 12 edges of the housing 10, to the upstream edge 12*b* working out to the upstream side in the rotation direction A of the sleeve 21 of the developing roll 20 and its top end comes into contact with the circumferential surface of the photoreceptor 61 along the rotation axis direction.

In FIG. 3, numeral 16 is a developer replenishment passage. The developer replenishment passage 16 is formed, for example, in a state of protruding from one end part of the conveying path 13*b* along the axis direction of the auger 30A and disposed in a state of allowing the auger 30A to extend into the replenishment passage, and at the same time, a receiving port 17 for receiving the developer conveyed and replenished from a developer replenishing device (not shown) is formed at the top on the protrusion end side of the passage. The developer for replenishment received from the receiving port 17 is conveyed into the conveying path 13*b* by a conveying force of the auger 30A. Also, in FIG. 4 and the like, numeral 18 indicates a hooking protrusion used when installing the housing cover part 10B to the housing main body 10A, and numeral 19 is a hooking claw used at the installation.

In the developing device 1, as shown in FIG. 2 and FIGS. 4 to 6, a film member 40 disposed such that one end part is fixed, out of opening 12 edges of the housing 10, on the downstream edge 12*a* side positioned in the rotation direction A downstream side of the sleeve 21 in the developing roll 20 and one end part opposing the one end part above is a free end and comes into contact with a layer of the developer held on the outer circumferential surface portion of the sleeve 21 after passing the downstream edge 12*a*, is provided. The film member 40 is provided in the housing cover part 10B.

The film member 40 is a member where the entirety having a length dimension longer than the width (in FIG. 5, symbol W) in the rotation axis direction B of at least the developer holding region 21*a* of the sleeve 21 is formed nearly in a rectangular shape. As regards the film member 40, for example, a synthetic resin such as polyurethane and PET (polyethylene terephthalate) formed into a film shape of from 50 to 300 μm or approximately from 50 to 300 μm in thickness is used.

In the film member 40, out of end parts in the longitudinal direction, one end part 40*a* lying on the rotation direction A upstream side of the sleeve 21 is attached and fixed to the inner wall surface part 10*a* working out to the downstream edge 12*a* of the opening 12 of the housing 10 by means of a fixing unit such as double-sided tape or pressure-sensitive adhesive. As for the inner wall surface part 10*a* to which one end part 40*a* of the film member is attached, the height (position), levelness and the like of the surface are set, for example, from the standpoint of adjusting the contact angle θ when the film member 40 contacts with the outer circumferential surface of the sleeve 21.

Furthermore, the film member 40 is disposed in a state of, out of end parts in the longitudinal direction, the other end part 40*b* on the rotation direction A downstream side of the sleeve 21 being a free end inside of the housing 10 and coming into contact with a layer (in FIG. 6, the top surface of the developer layer shown by a two-dot chain line 3*a*) of the developer held on the outer circumferential surface of the sleeve 21 after passing the downstream edge 12*a* of the opening 12. At this time, the film member 40 is provided in a state of coming into contact with the outer circumferential surface of the sleeve 21 at least in an acute angle range (preferably, at an angle selected in a numerical value range of θ=15 to 60° in terms of the contact angle θ in FIG. 6).

Figure 6:
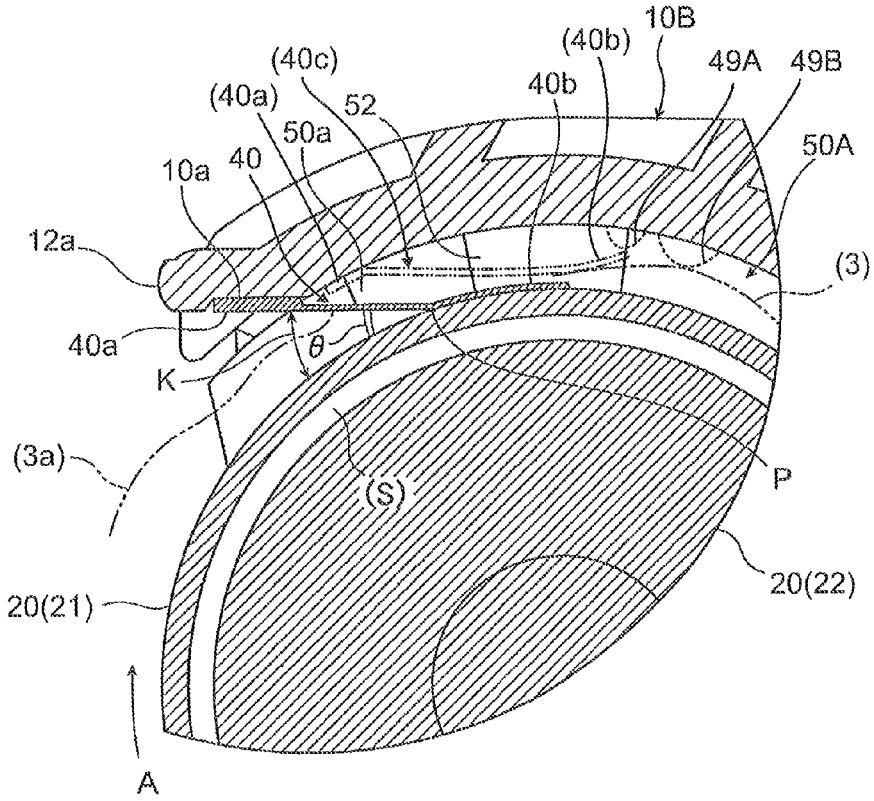
FIG. 6 represents an enlarged view showing a part (the state of the downstream edge of the opening and its periphery) of the developing device of FIG. 2.
Figure 7:
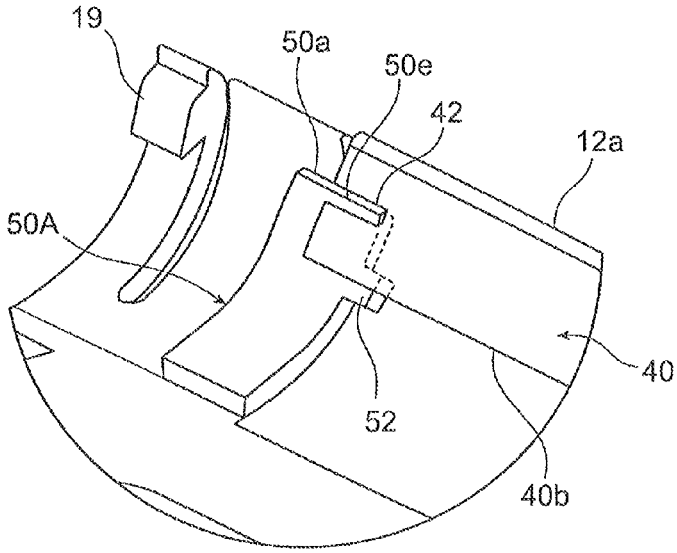
FIG. 7 represents an enlarged view of the circle Q portion surrounded by a two-dot chain line in FIG. 4.

The contact angle θ is, as shown in FIG. 6, an angle substantially corresponding to the central angle of an arc K that is present between the bottom surface portion of the film member 40 attached to the inside edge of the inner wall surface part 10*a* and the outer circumferential surface of the sleeve 21 with respect to a circle passing the bottom surface part and intersecting the outer circumferential surface out of a circle with the center point being a point P at which the film member 40 attached to the wall surface part 10*a* is first put into contact with the outer circumferential surface (outer circumferential surface in a state of not having a developer layer).

The thus-provided film member 40 is present, as shown in FIG. 6, in a state of gradually coming close to and into contact with the outer circumferential surface (layer 3*a* of the developer) of the sleeve 21 while peaking (into a tapered state) on the rotation direction A downstream side of the sleeve 21 to form a space S having a wedge-shaped cross-section as a whole together with the outer circumferential surface before contacting therewith. At this time, the other end part 40*b* side as a free end is present in a state of being easily deformable (displaceable) to undergo a deflection according to the condition of an object to be contacted with. Also, the film member 40 is present in a state of stopping the gap between the downstream edge 12*a* of the opening 12 of the housing 10 and the outer circumferential surface at least in the developer holding region 21*a* of the sleeve 21.

Figure 5:
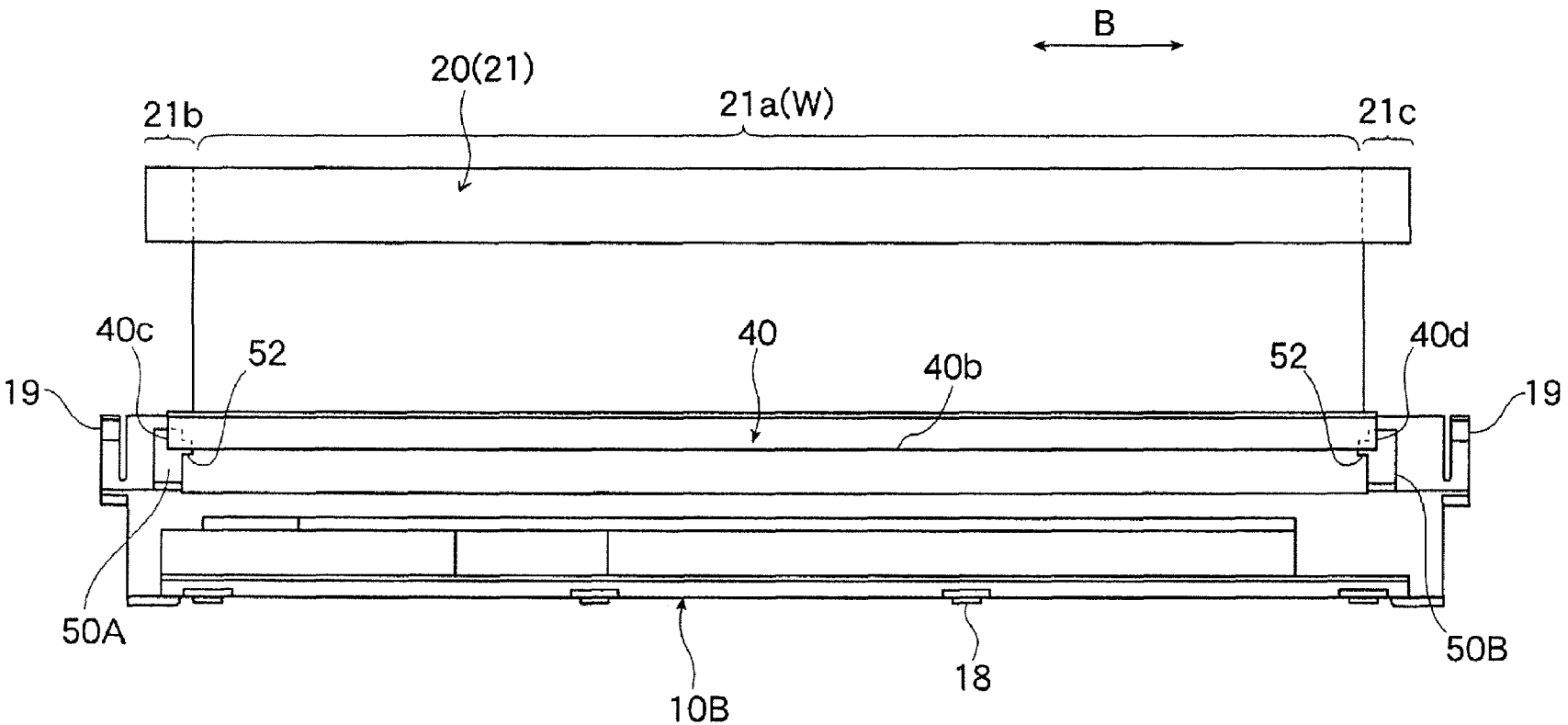
FIG. 5 represents an explanatory view showing the relationship between the housing cover part and the developing roll (sleeve) of FIG. 4.

In the developing device 1, as shown in FIGS. 2, 4 and 5 and the like, end sealing members 50A and 50B that are put into contact respectively with both end parts 21*b* and 21*c* of the outer circumferential surface positioned outside of the develop holding region 21*a* in the sleeve 21 of the developing roll after passing the downstream edge 12*a* of the opening 12 of the housing 10, are provided.

The end sealing members 50A and 50B are a nearly rectangular member long in the rotation direction A of the sleeve 21 and attached/fixed to the inner wall surface portion of the housing cover part 10B by means of a fixing unit such as double-sided tape or pressure-sensitive adhesive to come into contact with both end parts 21*b* and 21*c* of the outer circumferential surface of the sleeve 21 to a predetermined width and a predetermined length. As regards the end sealing member 50, for example, a felt of 2 to 6 mm in thickness formed of Teflon (registered trademark) or the like is used. The end sealing members 50A and 50B are, as shown FIG. 8, disposed to come into contact with the sleeve end parts 21*b* and 21*c* in a state of producing a gap α from the outside boundary (the portion indicated by the dotted line in the Figure) of the developer holding region 21*a* of the sleeve 21.

The end sealing members 50A and 50B are present in a state of stopping the gap between the inner wall surface of the housing cover part 10B and the top part of both end parts 21*b* and 21*c* of the sleeve 21, whereby a developer 3 (mainly toner) passing through the gap to leak outside from the opening 12 is blocked.

Also, the film member 40 is provided in a state of allowing both end parts 40*c* and 40*d* in the longitudinal direction along the rotation axis direction B of the sleeve 21 of the developing roll to extend, as shown in FIGS. 4 and 5 and the like, to the position overlapping with a part of the end sealing members 50A and 50B.

Figure 8:
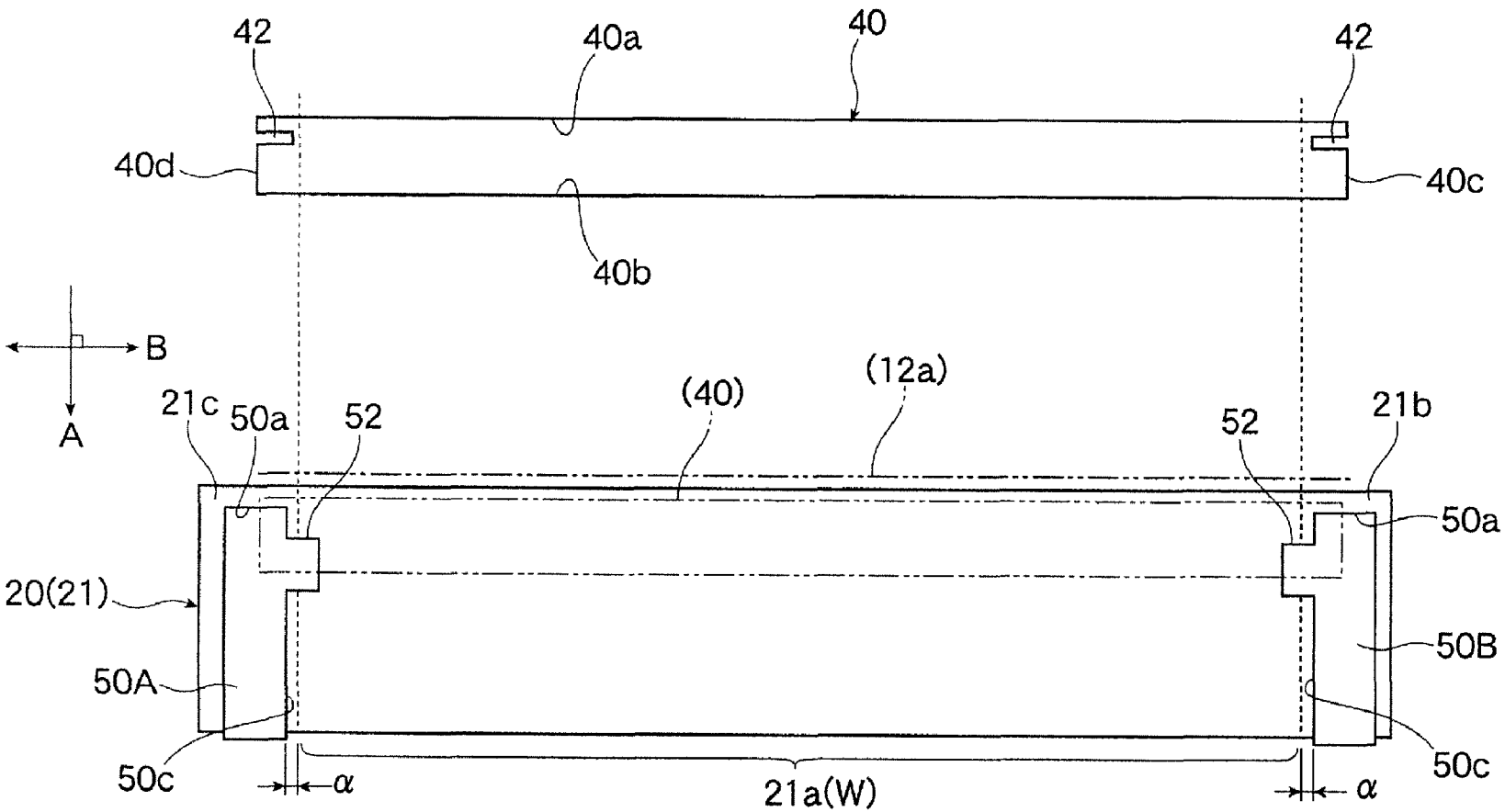
FIG. 8 represents an explanatory view showing the relationship among the film member, the end sealing member and the developing roll (sleeve)
Figure 9:
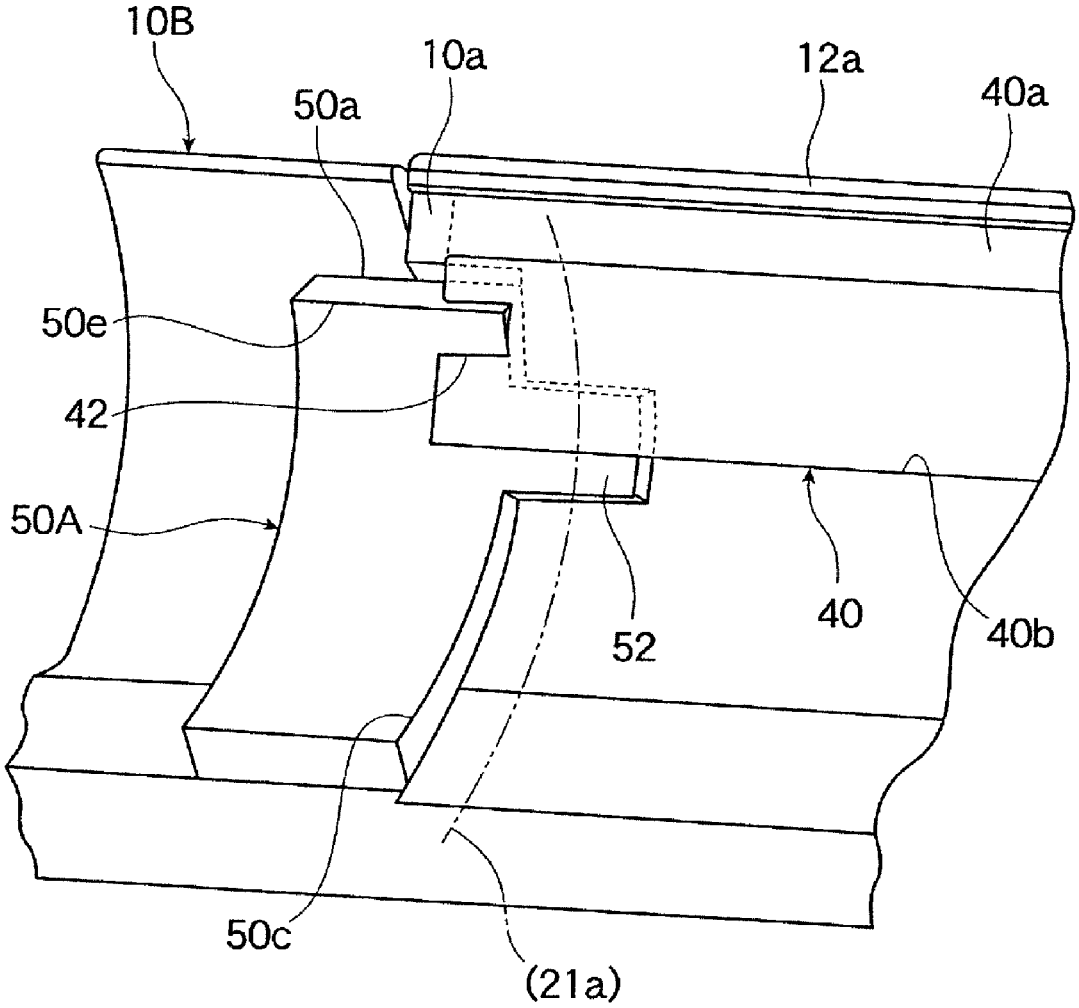
FIG. 9 represents an enlarged view showing a part of the portion shown in FIG. 7 in a more enlarged manner.

In this case, the end sealing members 50A and 50B each is, as shown in FIGS. 4 to 6 and the like, in a relationship of its upstream end part 50*a* positioned on the downstream edge 12*a* side of the opening being disposed on the more receding side of the casing 10 (rotation direction A downstream side of the sleeve 21) than one end part 40*a* of the film member 40. Therefore, the film member 40 overlaps with a part of at least the upstream end part 50*a* of the end sealing members 50A and 50B. Thanks to this overlapping, as shown in FIG. 8 and the like, a state of the gap (the sleeve end region indicated by the gap α above) between the developer holding region 21*a* of the sleeve 21 and the end sealing member 50A or 50B being stopped by the film member 40 on the downstream edge 12*a* side of the opening is provided, and a gap passage having a possibility of allowing the developer 3 in the inside (housing part 13) of the casing 10 to leak outside of the casing is eliminated.

In the end sealing members 50A and 50B, as shown in FIG. 5 to 9, at their end part 50*c* neighbored by the developer holding region 21*a* of the sleeve 21, a protrusion 52 protruding to the developer holding region 21*a* side is formed in a state of including the portion overlapped with the film member 40. The protrusion 52 is sufficient if it protrudes to an extent of being present in the gap between at least the developer holding region 21*a* of the sleeve 21 and the end sealing member 50A or 50B. Also, the protrusion is set so that the amount of the portion intruding into the inside of the developer holding region 21*a* of the sleeve 21 can be small as much as possible.

The protrusion 52 of the end sealing members 50A and 50B is present in a state of blocking the gap between the developer holding region 21*a* of the sleeve 21 and the end sealing member 50A or 50B from communicating with the downstream edge 12*a* side of the opening, thereby producing a state where a gap passage having a possibility of allowing the developer 3 in the inside (housing part 13) of the casing 10 to pass the gap and leak outside of the casing is unfailingly blocked.

Furthermore, in the film member 40, as shown in FIG. 4 and FIGS. 7 to 9, a notch part 42 avoiding contact with a corner part 50*e* of the end sealing members 50A and 50B, which is most protruding to the film member 40 side, is formed at the end parts 40*c* and 40*d* overlapping with the end sealing members 50A and 50B. The notch part 42 is set to the position, shape and size causing no contact with the corner part 50*e* portion of the end sealing member, so that when disposing the end parts 40*c* and 40*d* of the end sealing member in a state of overlapping with the end sealing members 50A and 50B, a state (posture) free from a fear of riding on the corner part 50*e* of the end sealing member and being partially deformed due to the effect of the corner part portion can be kept.

By virtue of the presence of this notch part 42, the end parts 40*c* and 40*d* of the film member 40 even when disposed to overlap with the end sealing members 50A and 50B can be prevented from riding on the corner part 50*e* of the end sealing member and being partially deformed and can be kept in the same state as the center portion other than the end parts 40*c* and 40*d*.

The operation of the developing device 1 is described below.

First, in the developing device 1, when the image forming apparatus 6 enters an operation time of image formation, the developing roll 20 and the screw augers 30A and 30B start rotating and at the same time, a development voltage is applied to the developing roll 20. As a result, the two-component developer 3 housed in the developer housing part 13 of the housing 10 is conveyed through the circulating paths 13*b* and 13*c* of the developer housing part 13 in the directions of arrows C1 and C2, respectively, with stirring by the rotating augers 30A and 30B, whereby the developer is conveyed in a state of being circulated as a whole (see, FIG. 3). At this time, the toner in the two-component developer 3 is thoroughly stirred with the carrier and enters a state of being frictionally charged and electrostatically adhering to the carrier surface.

Subsequently, a part of the two-component developer 3 conveyed by the auger 30B on the side closer to the developing roll 20 is adsorbed to the developing roll 20 by magnetic force and held thereon, that is, held in a state of a large number of toner-attached magnetic carriers being connected like a chain and erected as if spikes by the magnetic force of the magnet roll 22 to form a magnetic brush on the outer circumferential surface of the rotating sleeve 21 in the developing roll 20. Thereafter, the two-component developer 3 held on the sleeve 21 passes through a fixed gap formed with the layer thickness-regulating plate 25 in the course of being conveyed along rotation of the sleeve 21, where the passing state is regulated to give a nearly constant layer thickness (height of the magnetic brush).

The two-component developer 3 having such a regulated layer thickness is conveyed by rotation of the sleeve 21 of the developing roll 20 to the development region E opposing the photoreceptor 61 in the opening 12 of the housing 10. The two-component developer 3 conveyed to the development region E is then caused to pass the region in a state of the distal end of the magnetic brush being in contact with the outer circumferential surface of the photoreceptor 61 and during the passing, only the toner is electrostatically attached to the electrostatic latent image on the photoreceptor 61 by the effect of a development (alternating) electric field formed between the developing roll 20 and the photoreceptor 61 by a development voltage applied to the developing roll 20, whereby development of the electrostatic latent image by the developing device 1 is performed.

On the other hand, the two-component developer 3 on the developing roll 20 after passing the development region E without contributing to the development passes the opening 12 in a state of being held on the outer circumferential surface of the sleeve 21 and is conveyed to the inside of the housing 10, and thereafter, in principle, the developer is separated from the sleeve 21 and returned to the inside (housing part) of the housing 10. This developer 3 separated and returned is again stirred in the developer housing part 13 of the housing 10, and the two-component developer 3 stirred in the developer housing part 13 is supplied and held on the developing roll 20 from which the developer is separated, so that the developer can be anew replenished based on the above-described principle.

In the developing device 1, the developer 3 (in practice, the toner) generated inside of the developer housing part 13 of the housing 10 is floating, and a part of the floating developer 3 slides on the inner wall surface of the housing cover part 10B to leak outside through the gap with the outer circumferential surface of the sleeve 21.

However, in this developing device 1, the developer floating to leak outside from the inside (housing part 13) of the housing 10 is cut off as described above by the film member 40 present to stop the gap between, out of the edges of the opening of the housing cover part 10B, the downstream edge 12*a* and the outer circumferential surface of the sleeve 21 and blocked from leaking outside through the gap between the downstream edge 12*a* of the opening and the outer circumferential surface of the sleeve 21.

Also, in the developing device 1, the magnetic brush layer (3*a*) of the two-component developer 3 held on the sleeve 21 of the developing roll after passing the downstream edge 12*a* out of edges of the opening of the housing cover part 10B is caused to contact with and then pass the film member 40 that is present in a state of being in contact with the outer circumferential surface of the sleeve 21 while gradually coming close from the downstream edge 12*a* in the inside of the housing 10.

At this time, the film member 40 is present, as described above, in a state of tapering on the rotation direction A downstream side of the sleeve 21 to form a space S having a wedge-shaped cross-section as a whole together with the outer circumferential surface (layer 3*a* of the developer) of the sleeve 21 before contacting with the outer circumferential surface. Therefore, the magnetic brush layer (3*a*) of the two-component developer 3 on the sleeve 21 after passing the downstream edge 12*a* passes the film member 40 while mildly contacting therewith by causing no instantaneous strong collision against the bottom surface of the film member 40. That is, the layer can pass the film member 40 without receiving a strong impact by the contact therewith.

Moreover, the film member 40 has flexibility enabling deformation to undergo a deflection and at the same time, keeps free the end part 40*b* on the side contacting with the outer circumferential surface of the sleeve 21 and therefore, even when the holding amount (layer thickness, height of magnetic brush, conveying amount) of the developer 3 held on the sleeve 21 varies, the film member deforms or displaces to follow the varied state. Also by this deformation or displacement, the magnetic brush layer of the developer 3 on the sleeve 21 after passing the downstream edge 12*a* can pass the film member 40 without receiving a strong impact by the contact therewith.

As a result, the developer 3 held on the sleeve 21 after passing the downstream edge 12*a* is prevented from partially escaping and floating from the magnetic brush by an impact upon contact with the film member 40 and in turn, from leaking outside through the downstream edge 12*a* of the opening of the housing 10.

Furthermore, in the developing device 1, the developer in the inside (housing part 13) of the housing 10 is not allowed to partially leak out from between the film member 40 and the end sealing member 50A or 50B.

Accordingly, in the developing device 1, a developer that leaks outside of the housing 10 is not present between, out of edges of the opening 12 of the housing 10, the downstream edge 12*a* and the outer circumferential surface of the sleeve 21 of the developing roll.

Thanks to these effects, the developing device 1 is free from a fear that a developer 3 leaked out from between the downstream edge 12*a* of the opening 12 of the housing 10 and the outer circumferential surface of the sleeve 21 floats to adhere to the outer circumferential surface side of the downstream edge 12*a* of the opening 12 and gradually accumulate, or a fear that the adhered and accumulated developer 3 falls as a mass due to some vibration or the like.

Also, the image forming apparatus 6 using this developing device 1 is free from a fear that the developer 3 accumulated on the outer circumferential surface side of the downstream edge 12*a* of the opening 12 in the developing device 1 falls as a mass to contaminate the interior of the casing of the image forming apparatus 6. Particularly, this image forming apparatus 6 can avoid a fear that the developer 3 falls or floats to attach to the light output part 62*a* of the exposure device 63 disposed and present at a position below the development region E and the light output part 62*a* is contaminated with the developer 3 to induce an exposure failure.

Other Embodiments

Figure 10:
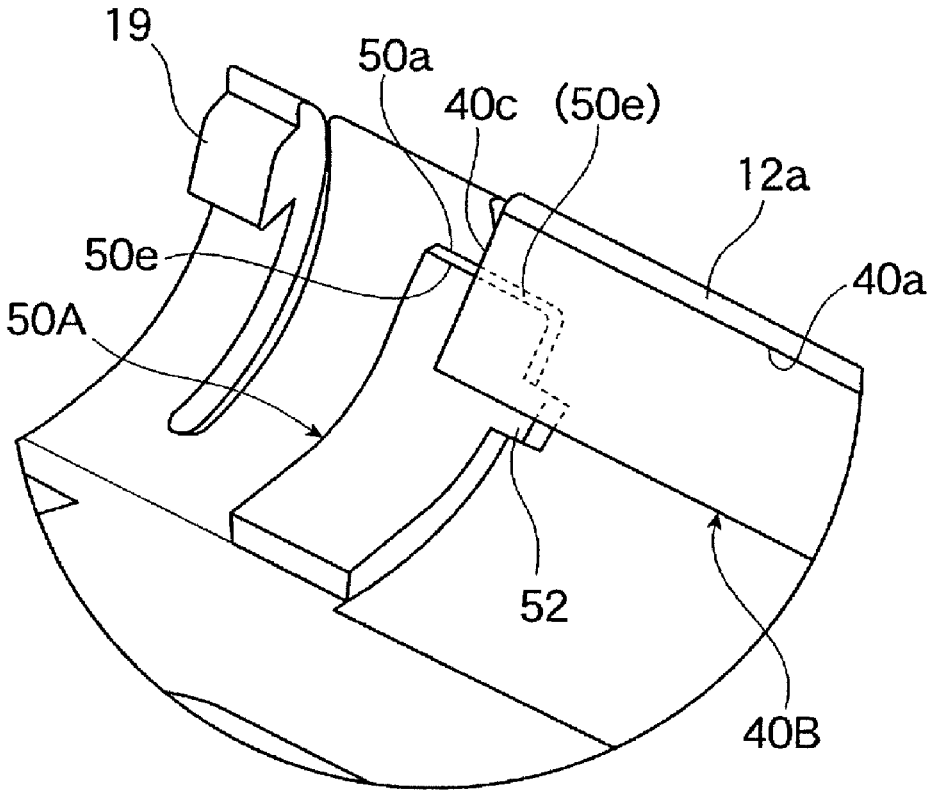
FIG. 10 represents a main part perspective view showing another construction example of the film member.

In the developing device 1 of the exemplary embodiment above, as illustrated in FIG. 10, a film member 40B having a construction of not forming a notch part 42 in its end parts 40*c* and 40*d* may also be used as the film member 40. Such a film member 40B can be employed when the film member scarcely suffers from an effect (e.g., deformation) of the corner part 50*e* of the upstream end part 50*a* overlapping with the film member of the end sealing members 50A and 50B, for example, when the end sealing members 50A and 50B is a soft material or the portion overlapping with the film member is formed to a small thickness. In addition, as for the film member 40, a sheet member composed of other materials or having other forms, dimensions or the like may be applied as long as it has at least flexibility.

Figure 11:
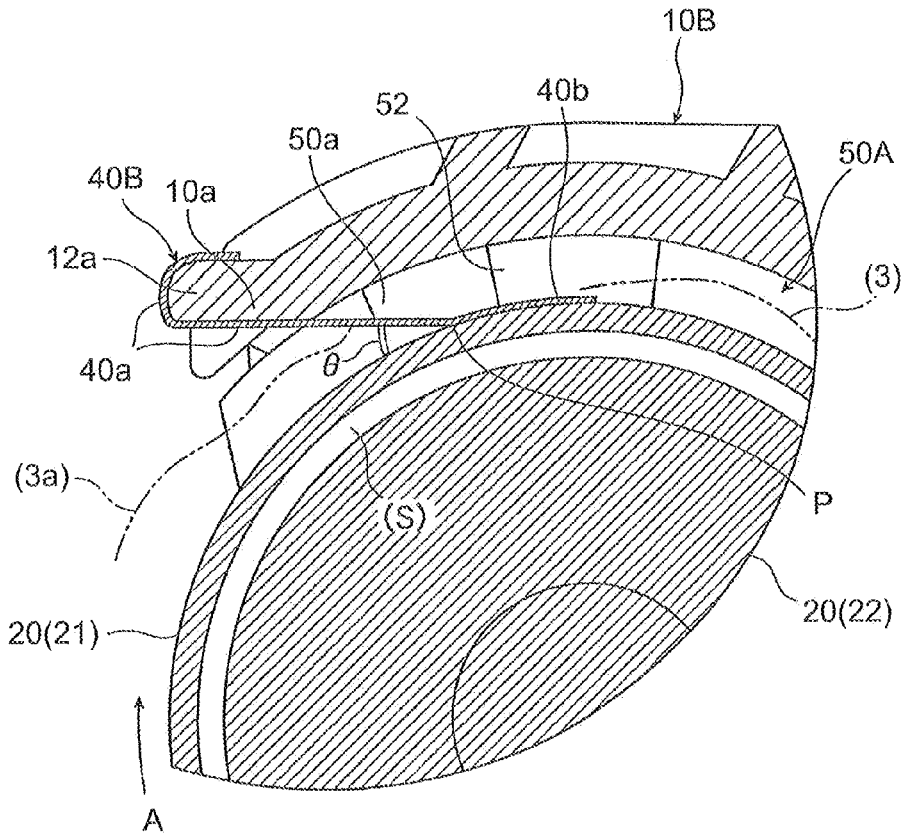
FIG. 11 represents an enlarged view showing another example of a part (the state of the downstream edge of the opening and its periphery) of the developing device of FIG. 2.

Also, as regards the method of fixing the film member 40 to the housing 10, other than the mode (FIG. 6) of the exemplary embodiment above, for example, the following constructions may also be employed. As an example, a method where, as shown in FIG. 11, one end part 40*a* of the film member 40B on the rotation direction A upstream side of the magnetic roll 21 is wound around the downstream edge 12*a* of the opening 12 of the housing 10 to fix the film member in a state of extending to the outer surface part of the downstream edge 12*a*, or a method where, as shown by a two-dot chain line, one end part 40*a* of the film member 40C is fixed to the inner wall at a position more receded to the inner side than the downstream edge 12*a* of the opening 12 of the housing 10, may be employed.

Also, in the developing device 1, an end sealing member having a construction of not forming a protrusion 52 may also be applied as the end sealing members 50A and 50B. Furthermore, in the developing device 1, as shown by a dotted line in FIG. 11, a protrusion 49 protruding to come close to the outer circumferential surface of the magnetic roll 21 may be formed on the inner wall surface on the rotation direction A downstream side of the magnetic roll 21 with respect to the downstream edge 12*a* of the opening 12 of the housing 10. In this case, the position at which the protrusion 49 is formed is, for example, a position above the other end part 40*b* (of the film member 40) lying on the rotation direction A downstream side of the magnetic roll 21 (protrusion 49A), or a position on the inner wall surface on the more downstream side in the rotation direction A of the magnetic roll 21 than the other end part 40*b* of the film member 40 (protrusion 49B).

The developing device when providing a film member 40 is preferably a developing device having a construction such that the downstream edge 12*a* of the opening 12 of the housing 10 is disposed above the rotation center point of the developing roll 20 (sleeve 21) as in the example of the exemplary embodiments above, but may be a developing device having a construction such that the downstream edge 12*a* of the opening 12 is disposed below the rotation center point of the developing roll 20 (sleeve 21). In addition, the developing device in which a film member 40 is provided may be, for example, a developing device using a so-called one-component developer composed of a toner, as long as it is effective.

The image forming apparatus 6 using a developing device in which a film member 40 is provided may be an image forming apparatus having a construction of using one or a plurality of image making apparatuses 61 without employing an intermediate transfer system. Also, as for the exposure device in the image making apparatus 61, instead of the exposure device illustrated in the exemplary embodiment above, an exposure device having a construction such that the light output part 63*a* is formed as an independent unit separately from the main body of the exposure device and the light output part 63*a* is disposed at a position below the photoreceptor 61, may also be applied.

The foregoing description of the exemplary embodiments of the present invention has been provided for the purpose of illustration and description. It is not intended to be exhaustive or to limit the invention to the precise forms disclosed. Obviously, many modifications and variations will be apparent to practitioners skilled in the art. The exemplary embodiments are chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. A developing device, comprising:

a casing that has:

a housing part that houses a developer;

an upstream edge and a downstream edge positioned in an upstream side and a downstream side of a rotation direction of a developer conveying body, respectively; and a rectangular opening that opposes a development region for performing development with the developer, the rectangular opening being provided between the upstream edge and the downstream edge;

a cylindrical developer conveying body that is provided inside of the casing to rotate in a state of passing the rectangular opening, the cylindrical developer conveying body conveying the developer to the development region by holding the developer on an outer circumferential surface;

a flexible sheet member that has an upstream end part and a downstream end part positioned in an upstream side and a downstream side of the rotation direction of the developer conveying body, respectively, the upstream end part of the flexible sheet member being fixed at the downstream edge of the casing, the downstream end part of the flexible sheet member being a free end and coming into contact with a layer of the developer in a rotation axis direction of the developer conveying body at a position of the developer conveying body which passes the downstream edge of the opening, the layer of the developer being held on the outer circumferential surface portion of the developer conveying body working out to a developer holding region, and developer leakage-preventing members that are provided inside of the casing in a state of coming into contact respectively with both end parts of the outer circumferential surface positioned on outer sides of the developer holding region in the rotation axis direction of the developer conveying body at a position of the developer conveying body which passes the downstream edge of the opening, and both end parts of the sheet member in the rotation axis direction of the developer conveying body each extend to a position overlapping with a part of the developer leakage-preventing member, wherein the sheet member has notch parts at the both end parts, overlapping with the developer leakage-preventing members, positioned between the upstream end part and the downstream end part of the sheet member, for avoiding contact with upstream corner parts of the developer leakage-preventing members by enclosing the upstream corner parts with the notch parts.

2. The developing device according to claim 1, wherein the developer leakage-preventing member has a protrusion having a form of protruding toward the developer holding region side at an end part of the developer leakage-preventing member, which is neighbored by the developer holding region of the developer conveying body, the protrusion including the portion overlapping with the sheet member.

3. The developing device according to claim 1, wherein the flexible sheet member is a film shape member having a thickness of approximately from 50 to 300 μm and made of a synthetic resin.

4. The developing device according to claim 3, wherein the synthetic resin contains at least one of polyurethane and polyethylene terephthalate.

5. The developing device according to claim 1, wherein the flexible sheet member is in contact with the outer circumferential surface of the cylindrical developer conveying body in an contact angle range of 15° to 60°.

6. An image forming apparatus, comprising:

an image making apparatus that develops an electrostatic latent image formed on an image holding member with a developer supplied from a developing device to form an image, wherein the developing device includes:

a casing that has:

a housing part that houses a developer;

an upstream edge and a downstream edge positioned in an upstream side and a downstream side of a rotation direction of a developer conveying body, respectively; and a rectangular opening that opposes a development region for performing development with the developer, the rectangular opening being provided between the upstream edge and the downstream edge;

a cylindrical developer conveying body that is provided inside of the casing to rotate in a state of passing the rectangular opening, the cylindrical developer conveying body conveying the developer to the development region by holding the developer on an outer circumferential surface;

a flexible sheet member that has an upstream end part and a downstream end part positioned in an upstream side and a downstream side of the rotation direction of the developer conveying body, respectively, the upstream end part of the flexible sheet member being fixed at the downstream edge of the casing, the downstream end part of the flexible sheet member being a free end and coming into contact with a layer of the developer in a rotation axis direction of the developer conveying body at a position of the developer conveying body which passes the downstream edge of the opening, the layer of the developer being held on the outer circumferential surface portion of the developer conveying body working out to a developer holding region, and developer leakage-preventing members that are provided inside of the casing in a state of coming into contact respectively with both end parts of the outer circumferential surface positioned on outer sides of the developer holding region in the rotation axis direction of the developer conveying body at a position of the developer conveying body which passes the downstream edge of the opening, and both end parts of the flexible sheet member in the rotation axis direction of the developer conveying body each extend to a position overlapping with a part of the developer leakage-preventing member, wherein the flexible sheet member has notch parts at the both end parts, overlapping with the developer leakage-preventing members, positioned between the upstream end part and the downstream end part of the flexible sheet member, for avoiding contact with upstream corner parts of the developer leakage-preventing members by enclosing the upstream corner parts with the notch parts.

7. A developing device, comprising;

a casing that has:

a housing part that houses a developer;

an upstream edge and a downstream edge positioned in an upstream side and a downstream side of a rotation direction of a developer conveying body, respectively; and a rectangular opening that opposes a development region for performing development with the developer, the rectangular opening being provided between the upstream edge and the downstream edge;

a cylindrical developer conveying body that is provided inside of the casing to rotate in a state of passing the rectangular opening, the cylindrical developer conveying body conveying the developer to the development region by holding the developer on an outer circumferential surface;

a flexible sheet member that has an upstream end part and a downstream end part positioned in an upstream side and a downstream side of the rotation direction of the developer conveying body, respectively, the upstream end part of the flexible sheet member being fixed at the downstream edge of the casing, the downstream end part of the flexible sheet member being a free end and coming into contact with a layer of the developer in a rotation axis direction of the developer conveying body at a position of the developer conveying body which passes the downstream edge of the opening, the layer of the developer being held on the outer circumferential surface portion of the developer conveying body working out to a developer holding region; and developer leakage-preventing members that are provided inside of the casing in a state of coming into contact respectively with both end parts of the outer circumferential surface positioned on outer sides of the developer holding region in the rotation axis direction of the developer conveying body at a position of the developer conveying body which passes the downstream edge of the opening, wherein both end parts of the sheet member in the rotation axis direction of the developer conveying body each extend to a position overlapping with a part of the developer leakage-preventing member, a protrusion member protruding to the developer holding region side is formed at an end part of the protrusion member neighbored by the developer holding region of the developer conveying body in a state of including a position overlapped with the sheet member, the sheet member has notch parts at an end part of the sheet member, overlapping with the developer leakage-preventing members, for avoiding contact with corner parts by enclosing the upstream corner parts with the notch parts, formed at an upstream end of the leakage-preventing members in a rotation direction of the developer conveying body, and the sheet member is in plane contact with the developer leakage-preventing members at the downstream part relative to the notch parts in the rotation direction of the developer conveying body.

8. A developing device, comprising:

a casing that has:

a housing part that houses a developer; an upstream edge and a downstream edge positioned in an upstream side and a downstream side of a rotation direction of a developer conveying body, respectively; and a rectangular opening that opposes a development region for performing development with the developer, the rectangular opening being provided between the upstream edge and the downstream edge;

a cylindrical developer conveying body that is provided inside of the casing to rotate in a state of passing the rectangular opening, the cylindrical developer conveying body conveying the developer to the development region by holding the developer on an outer circumferential surface;

a flexible sheet member that has an upstream end part and a downstream end part positioned in an upstream side and a downstream side of the rotation direction of the developer conveying body, respectively, the upstream edge of the casing, the downstream end part of the flexible sheet member being fixed at the downstream edge of the casing, the downstream end part of the flexible sheet member being a free end and coming into contact with a layer of the developer in a rotation axis direction of the developer conveying body at a position of the developer conveying body which passes the downstream edge of the opening, the layer of the developer being held on the outer circumferential surface portion of the developer conveying body working out to a developer holding region; and developer leakage-preventing members that are provided inside of the casing in a state of coming into contact respectively with both end parts of the outer circumferential surface positioned on outer sides of the developer holding region in the rotation axis direction of the developer conveying body at a position of the developer conveying body which passes the downstream edge of the opening, and both end parts of the sheet member in the rotation axis direction of the developer conveying body each extend to a position overlapping with a part of the developer leakage-preventing member, the flexible sheet member has notch parts at an end part of the flexible sheet member, overlapping with the developer leakage-preventing members, for avoiding contact with corner parts by enclosing the upstream corner parts with the notch parts, formed at an upstream end of the leakage-preventing members in a rotation direction of the developer conveying body, wherein the developer leakage-preventing members are provided across a line drawn from the downstream edge of the casing to the cylindrical developer conveying body, and the line is parallel to a contact surface where the upstream end part of the flexible sheet member and the downstream edge of the casing contact.

* * * * *